US006849129B2

(12) United States Patent
Bilz et al.

(10) Patent No.: US 6,849,129 B2
(45) Date of Patent: Feb. 1, 2005

(54) PAINT-SPRAYING APPARATUS FOR APPLYING LIQUID COATING MATERIAL TO WORKPIECES

(75) Inventors: Burkhard Bilz, Goldbach (DE); Udo Klein, Dietzenbach (DE); Joachim Kunkel, Rothenbuch (DE); Winfried Ott, Rodgau (DE)

(73) Assignee: LacTec GmbH, Rodgau (DE)

( * ) Notice: Subject to any disclaimer, the term of this patent is extended or adjusted under 35 U.S.C. 154(b) by 63 days.

(21) Appl. No.: 10/388,377

(22) Filed: Mar. 12, 2003

(65) Prior Publication Data

US 2004/0020428 A1 Feb. 5, 2004

(30) Foreign Application Priority Data

Mar. 13, 2002 (DE) ..... 102 11 244

(51) Int. Cl.[7] ..... B05B 5/025; F23D 11/32

(52) U.S. Cl. ..... 118/629; 118/302; 239/690; 239/691; 239/693; 239/116; 239/569

(58) Field of Search ..... 118/620, 621, 118/627, 629, 688, 302; 239/690, 693, 112, 124, 691, 106, 116, 569

(56) References Cited

U.S. PATENT DOCUMENTS

| | | | | |
|---|---|---|---|---|
| 4,275,834 | A | | 6/1981 | Spanjersberg et al. |
| 4,313,475 | A | | 2/1982 | Wiggins |
| 5,083,711 | A | | 1/1992 | Giroux et al. |
| 5,192,595 | A | | 3/1993 | Akeel et al. |
| 5,193,572 | A | | 3/1993 | Le Devehat |
| 5,197,676 | A | | 3/1993 | Konieczynski et al. |
| 5,221,047 | A | | 6/1993 | Akeel |
| 5,288,525 | A | | 2/1994 | Diana |
| 5,289,947 | A | | 3/1994 | Akeel et al. |
| 5,310,120 | A | | 5/1994 | Ehinger et al. |
| 5,326,031 | A | | 7/1994 | Konieczynski |
| 5,364,035 | A | | 11/1994 | Ma et al. |
| 5,632,816 | A | | 5/1997 | Allen et al. |
| 5,647,542 | A | * | 7/1997 | Diana ..... 239/690 |
| 6,037,010 | A | | 3/2000 | Kahmann et al. |
| 6,090,450 | A | | 7/2000 | Kahmann et al. |
| 6,422,491 | B1 | | 7/2002 | Bilz et al. |
| 6,582,774 | B2 | | 6/2003 | Klein et al. |
| 6,589,348 | B2 | | 7/2003 | Ott |

FOREIGN PATENT DOCUMENTS

| | | |
|---|---|---|
| DE | 4427704 | 6/1995 |
| DE | 19756488 | 7/1999 |
| DE | 19817377 | 11/1999 |
| DE | 19961270 | 6/2001 |
| DE | 10064065 | 7/2001 |
| EP | 0808665 | 11/1997 |
| FR | 9210746 | 3/1994 |
| WO | WO87/05832 | 10/1987 |

* cited by examiner

*Primary Examiner*—Chris Fiorilla
*Assistant Examiner*—Yewebdar Tadesse
(74) *Attorney, Agent, or Firm*—W. F. Fasse; W. G. Fasse

(57) ABSTRACT

The paint-spraying apparatus exhibits a supply line 7 for coating material, extending from the color changer to the atomizer. Cut-off valves 26, 27 installed in the supply line delimit an insulating section 25 of said supply line, which insulating section is associated with means 28 to 32 for emptying and flushing said insulating section 25. A voltage divider 16 is connected in parallel to said insulating section 25. When colors are changed, the residual coating material present in said voltage divider 16 can be moved into the empty insulating section 25, after which it is forced by means of slugs back through the entire supply line 7 to the color changer 1, and is thus reclaimed.

11 Claims, 1 Drawing Sheet

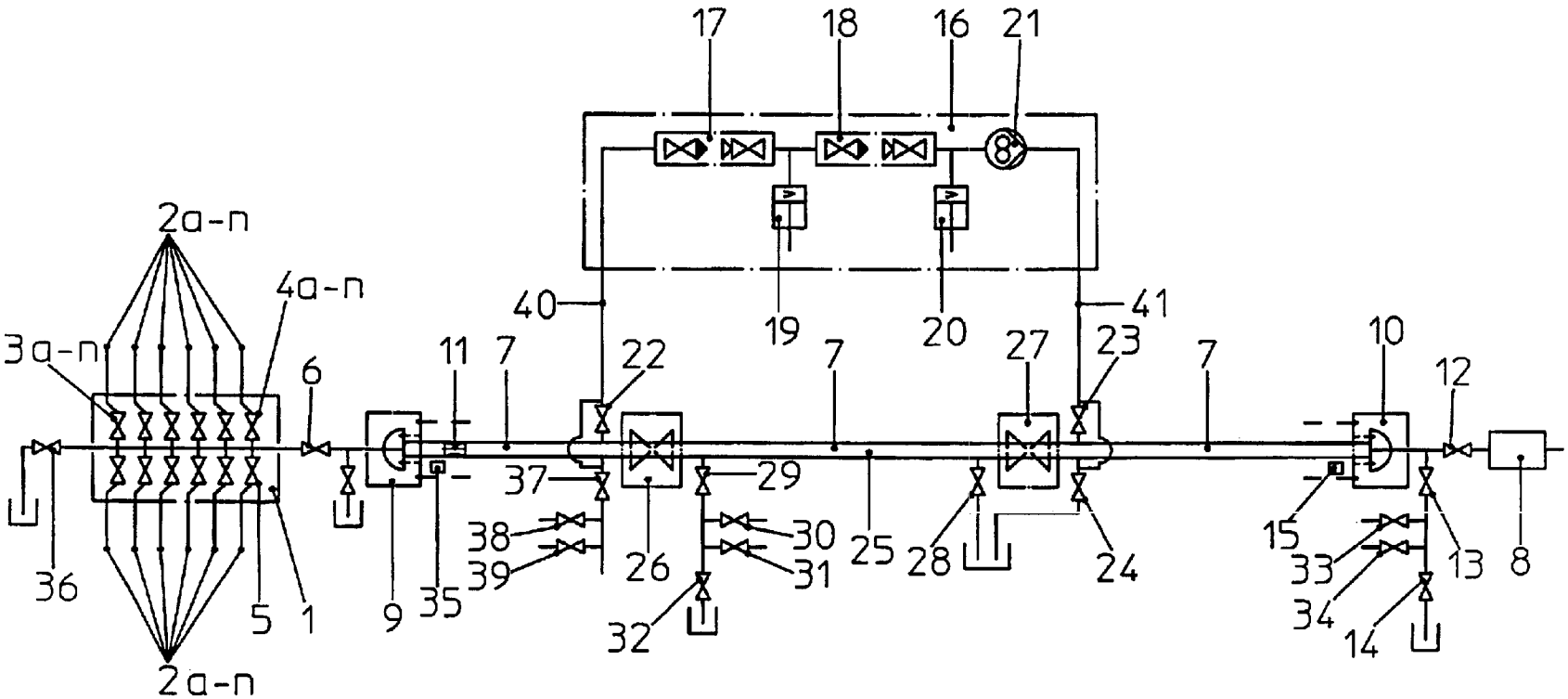
8
12
13
10
14
33
34
15
7
41
23
24
21
27
16
20
28
25
18
7
19
30
31
29
17
32
22
26
40
37
38
39
7
11
35
9
4a-n
6
1
5
2a-n
2a-n
3a-n
36

PAINT-SPRAYING APPARATUS FOR APPLYING LIQUID COATING MATERIAL TO WORKPIECES

The invention relates to a paint-spraying apparatus for the application of liquid coating material to workpieces and comprising an automatically actuatable color changer, an atomizer which can be connected to high voltage, a supply line of electrically insulating material extending between the color changer and the atomizer and through which a slug can be moved back and forth, and having a voltage divider connected to the supply line to effect electrostatic insulation of the color changer from the atomizer and from at least one storage vessel provided for storage of the coating material and attached to the supply line.

Such paint-spraying apparatus, used for electrostatic coating of, in particular, motor vehicle bodies, is disclosed in DE 199 61 270 A1. In said reference there are provided two storage vessels whose volume can be changed by means of a reciprocatable piston. Also provided are a first supply line between the color changer and the first storage vessel, and a second supply line between the first and second storage vessels. The supply lines can each be emptied using a slug so as to form an insulating strip preventing sparkover from the first storage vessel to the color changer and from the second storage vessel to the first storage vessel respectively.

The known system operates in such a manner that coating can be effected continuously from the second storage vessel connected to a high potential, to which end a metering conveyor in the form of a gear-type pump is provided, whilst the first storage vessel is alternately connected to high potential and to zero potential so that, during the coating operation, it can be alternately filled from outside and emptied into the second storage vessel.

When changing colors, the residual paint in the storage vessels can be forced back into the color changer by means of the piston so that these quantities of paint are not wasted. But this does not apply to the coating material still present in the pipes between the color changer and the atomizer. This loss of paint is considerable, because the coating material flows through two supply lines which are in staggered relationship to each other, of which each serves as an insulating strip and extends over a correspondingly long distance and, moreover, the path of the coating material through the storage vessels and other internals is interrupted. For this reason, it is virtually impossible to reclaim the coating material from the individual pipe sections. On the contrary, these pipe sections must be emptied and cleaned when changing colors, which gives rise to corresponding wastage.

This drawback is overcome by the present invention, whose object it is is to reduce wastage of coating material when changing colors.

This object is achieved by the invention in a paint-spraying apparatus of the aforementioned type in that the supply pipe has an insulating section delimited by cut-off valves and having a length sufficient to prevent sparkover, which section of the supply pipe can, when said cut-off valves are closed, be emptied and flushed free of residues of coating material by means of a device, and in that the voltage divider is connected to the supply line parallel to the insulating section, and in that the coating material present in the paint supply pipe outside the insulating section can be forced back into the color changer by a slug, to which end said slug can pass through the two cut-off valves delimiting the insulating section, when said valves are open.

Advantageous embodiments and developments of the invention are discernable from the sub-claims.

Due to the construction proposed by the invention, which is explained below in detail, almost the entire amount of coating material still present in the paint-spraying apparatus when changing colors can be retrieved, except for that present in the color changer. The loss incurred is substantially limited to a volume of paint equal to the capacity of the sole insulating section of the supply line.

A working example of the paint-spraying apparatus of the invention is explained in detail below with reference to a diagrammatic drawing.

As shown in the drawing, a color changer 1 is connected to a circular line system 2, from which different color shades a–n can be fed thereto.

Each individual ring line is associated. In the color changer 1, with a color shade valve 3*a* to 3*n*, by means of which the respective shade of paint is released into the color changer 1. At the exit end of the color changer 1 there are located flushing valves 4*a*–4*n* for passing in flushing agent and air purging valves 5*a*–5*n* for passing in scavenging air. Via a release valve 6, the released paint shade is fed into a supply line 7 extending from the color changer 1 to an atomizer 8.

Just downstream of the release valve 6 there is disposed a first, or front, slug parking station 9 which, as regarded in the direction of paint flow, represents one end or the front end of a slug path identical to supply line 7. The other, second end of the slug path, as regarded in the direction of paint flow, likewise takes the form of a slug parking station 10 and is disposed directly upstream of, or in, the atomizer 8. When coating material is fed from the color changer 1 into the supply line 7, the coating material pushes a slug 11, initially located in the slug parking station 9, forward until it reaches the slug parking station 10. The slug parking station 10 is designed such that the coating material can flow past or around the slug 11 and escape via the atomizer valve 12 of atomizer 8.

During triggering, a release valve 13 and an outlet valve 14 at the end of the supply line 7 are opened. The slug parking station 10 is provided with a sensor 15, which detects the arrival of the slug 11 and thus cessation of the triggering operation. Instead of using a slug sensor 15, the duration of triggering may be controlled by measuring the amount of paint fed in or by registering the triggering time.

When, as intended, the atomizer 8 is one which is to be connected to a high-tension potential and the coating material used is an electrically conductive paint, eg, a so-called water enamel, care must be taken to ensure that no short-circuiting occurs during operation via the paint supply pipe 7 filled with conductive paint.

For this purpose, there is provided between color changer 1 and atomizer 8 a voltage divider 16, which makes it possible to effect the required voltage division. The construction and operation of such a voltage divider are known to the person skilled in the art. Details thereof are disclosed in DE 197 56 488 A1.

The essential components of the voltage divider 16 comprise a first voltage-divider valve 17 and a second voltage divider valve 18 and also a first storage cylinder 19 and a second storage cylinder 20 for the coating material, both of which cooperate with a piston.

Finally, these components are adjoined by a metering element 21 connected downstream thereof. Said metering element may be a gear-type metering pump, for example. Alternatively, instead of a gear-type metering pump, use could be made of a remote-controlled pneumatic paint pressure regulator, for which various installation points might be advantageous.

The voltage divider 16 is connected to the supply line 7 via a front connecting pipe 40 and a rear connecting pipe 41, each provided with a cut-off valve 22 and 23 respectively. The cut-off valves 22 and 23 are located in the direct vicinity of the supply line 7. The coating material present in the supply line 7 can thus also be fed into the voltage divider 16 and its storage cylinders 19 and 20. To the rear connecting pipe 41 there is connected, just upstream of cut-off valve 23, a discharge line having a discharge valve 24

For the purpose of filling the voltage divider 16, the cut-off valves 22 and 23 in the connecting pipes 40 and 41 are held open until the voltage divider 16 is filled. Metering of the required quantity can be carried out with the aid of metering element 21. When the voltage divider 16 is completely filled, the discharge valve 24 closes.

Before high voltage can be applied to atomizer 18, a section of the supply line 7, namely the insulating section 25, must be flushed free of the conductive coating material present therein. The insulating section 25 extends between cut-off valves 26 and 27. These are a front cut-off valve 26 and a rear cut-off valve 27, which delimit the insulating section 25, are built into the supply line 7, and take the form of sluggable ball valves. This means that the inside diameters of the two ball valves are exactly equal to the inside diameter of the supply line 7 so that the slug can travel through cut-off valves 26 and 27, when open. The insulating section 25 between the two cut-off valves 26 and 27 forms a by-pass for the voltage divider 16.

Flushing of the insulating section 25 is effected with the cutoff valves 26 and 27 closed. A discharge valve 28 just upstream of the rear cut-off valve 27 is opened, and scavenging air and flushing agent are passed into the insulating section 25 via a release valve 29 directly downstream of the front cut-off valve 26 and via an air purging valve 31 and a flushing valve 30 respectively. The release valve 29 and discharge valve 28 are disposed such that the coating material present in the insulating section 25 is flushed out without leaving residues.

Once the coating material has been completely removed from the insulating section 25, the latter is blown dry with pressurized air so that it becomes fully non-conductive. The length of the insulating section 25 is kept as short as possible so that there is minimum waste of paint incurred by flushing. However, the insulating section 25 must be of adequate length to ensure that the high voltage applied to the atomizer 8 is reliably insulated from zero potential.

In this state the plant is operable. High voltage can now be applied to the atomizer 8, the voltage divider 16 can start to function, and the electrostatic coating process can be carried out. On conclusion of the operation using one color shade, it is desirable to recover the residual amount of coating material present in the apparatus as completely as possible. This recovery process is carried out as follows.

First of all, the atomizer valve 12 is dosed and the high voltage switched off. Cut-off valve 23 in the rear connecting pipe 41, rear cut-off valve 27, release valve 29, and discharge valve 32 are all opened. As much of the coating material present in the voltage divider 16 between the cut-off valves 22 and 23 as possible is then fed into the empty insulating section with the aid of the metering element 21, with the cut-off valve 22 closed and the release valve 37 open, the said insulating section thus being completely filled with coating material.

Cut-off valve 23, release valve 29, and discharge valve 32 are then closed, and front cut-off valve 26 and release valve 13 for the atomizer 8 are opened. Then the sliding air valve 33 located on the atomizer 8 is opened and the slug 11, which is positioned at the parking station 10, is pressed through the supply line 7 in the direction of the color changer 1 under a pneumatic pressure higher than the pressure in the circular line system 2. During this operation it pushes the coating material located in supply line 7 so as to press it back through the opened color shade valve **3*n* into the associated circular line 2*n*. When slug 1 arrives at the slug parking station 9, it is detected by a sensor 35** located at this point, after which this reclaiming operation is completed.

Subsequent purging of the supply line 7 is effected by opening flushing valve 34 situated on the atomizer 8 alternately with sliding air valve 33 likewise located on the atomizer.

By this means, paint residues remaining in the supply line 7 are flushed out through discharge valve 36 on color changer 1.

Concurrently, the voltage divider 16 comprising connecting pipes 40 and 41 is flushed, with release valve 37 and discharge valve 24 both open, by alternately opening and closing a release valve 37 assigned to flushing valve 38 and an adjacent air purging valve 39.

On conclusion of these flushing operations, the plant is again ready for acceptance of a different paint shade from the color changer 1. The necessary flushing time can be considerably reduced by using warm rinsing agent for flushing the individual pipe sections.

It is evident that the mode of operation described above restricts the wastage of coating material incurred during the process of changing color substantially to the amount of paint contained in the insulating section 25, such paint being rinsed out when the required amount of paint of the current shade has been sprayed. The remaining, non-sprayed quantities of paint are substantially completely recovered—apart from the coating material adhering to the inner surfaces of the pipes, which is flushed out.

What is claimed is:

1. A paint-spraying apparatus for the application of liquid coating material to workpieces and comprising an automatically actuatable color changer (1), an atomizer (8) which can be connected to high voltage, a supply line (7) of electrically insulating material extending between said color changer (1) and said atomizer (8), through which supply line (7) a slug (11) can be moved back and forth, and having a voltage divider (16) connected to said supply line (7) to effect electrostatic insulation of said color changer (1) from the atomizer (8) and from at least one storage vessel (19, 20) provided for storage of the coating material and attached to said supply line (7), characterized in that said supply pipe (7) has an insulating section (25) delimited by cut-off valves (26, 27) and having a length sufficient to prevent sparkover, which section (25) of the supply pipe (7) can, when said cut-off valves (26, 27) are closed, be emptied and flushed free of residues of coating material by means of a device (28–32), said voltage divider (16) is connected to the supply line parallel to the insulating section (25), and the coating material present in said paint delivery pipe (7) outside said insulating section (25) can be forced back into said color changer (1) by said slug (11), to which end said slug can pass through the two cut-off valves (26, 27) delimiting said insulating section (25), when said valves (26, 27) are open.

2. A paint-spraying apparatus as defined in claim 1, characterized in that, when changing colors, the residual coating material present in said voltage divider (16) can be moved into an empty insulating section (25) of said supply line (7).

3. A paint-spraying apparatus as defined in claim 2, characterized in that said voltage divider (16) has, at its atomizer-near end, a metering device (21) for the coating material, by means of which the residual coating material can be transported into said insulating pipe section (25).

4. A paint-spraying apparatus as defined in claim 3, characterized in that said metering device (21) is a gear-type pump.

5. A paint-spraying apparatus as defined in claim 1, characterized in that said cut-off valves (26, 27) delimiting said insulating pipe section (25) are ball valves whose passage diameter is equal to the internal diameter of the paint supply line (7).

6. A paint-spraying apparatus as defined in claim 1, characterized in that said insulating pipe section (25) of said supply line (7) is adjoined, in the immediate vicinity of said cut-off valves (26, 27), by a discharge valve (32) and release valve (29), respectively, with no intermediate dead space.

7. A paint-spraying apparatus as defined in claim 6, characterized in that there are connected to said release valve (29) a flushing line containing a flushing valve (30) and an air purging line containing an air purging valve (31).

8. A paint-spraying apparatus as defined in claim 1, characterized in that two connecting pipes (40, 41) for connecting said voltage divider (16) to said supply line (7) are provided, in the immediate vicinity of said supply line (7), with cut-off valves (22, 23) and, without intermediate dead space, a discharge valve (24) and a release valve (37) respectively.

9. A paint-spraying apparatus as defined in claim 8, characterized in that said release valve (37) is connected to a flushing line containing a flushing valve (38) and an air purging line containing an air purging valve (39).

10. A paint-spraying apparatus as defined in claim 1, characterized in that to the ends of said supply line (7) beyond a first slug parking station (9) and a second slug parking station (10), respectively, there are connected a discharge valve (36) and a release valve (13).

11. A paint-spraying apparatus as defined in claim 10, characterized in that said release valve (13) is connected to a flushing line containing a flushing valve (33) and an air purging line containing an air purging valve (34).

* * * * *